US007451946B2

(12) United States Patent
Virving

(10) Patent No.: US 7,451,946 B2
(45) Date of Patent: Nov. 18, 2008

(54) REFINING ELEMENT

(75) Inventor: Nils Virving, Hässelby (SE)

(73) Assignee: Metso Paper, Inc. (FI)

( * ) Notice: Subject to any disclaimer, the term of this patent is extended or adjusted under 35 U.S.C. 154(b) by 558 days.

(21) Appl. No.: 10/541,478

(22) PCT Filed: Dec. 11, 2003

(86) PCT No.: PCT/SE03/01928

§ 371 (c)(1),
(2), (4) Date: Jul. 6, 2005

(87) PCT Pub. No.: WO2004/062807

PCT Pub. Date: Jul. 29, 2004

(65) Prior Publication Data

US 2006/0151649 A1 Jul. 13, 2006

(30) Foreign Application Priority Data

Jan. 14, 2003 (SE) ..... 0300082

(51) Int. Cl.
*B02C 7/04* (2006.01)
*B02C 7/06* (2006.01)
*B02C 13/20* (2006.01)

(52) U.S. Cl. ..... 241/261.1; 241/261.3

(58) Field of Classification Search ..... 241/298, 241/261.1, 261.3
See application file for complete search history.

(56) References Cited

U.S. PATENT DOCUMENTS 4,090,672 A * 5/1978 Ahrel ..... 241/261.1
4,283,016 A * 8/1981 Reinhall ..... 241/21
5,042,726 A * 8/1991 Reinhall ..... 241/28
5,704,559 A * 1/1998 Froberg et al. ..... 241/261.3

FOREIGN PATENT DOCUMENTS

SE 441 649 B 10/1985

* cited by examiner

*Primary Examiner*—Bena Miller
(74) *Attorney, Agent, or Firm*—Lerner, David, Littenberg, Krumholz & Mentlik, LLP

(57) ABSTRACT

Refining elements for use in a refining apparatus for refining lignocellulosic fibrous material between a pair of refining members are disclosed. The refining element is adapted to be mounted on the inwardly facing conical surface of an outer stationary refining member and includes a plurality of bars and intermediate grooves in which the bars extend along the refining gap and include a pair of side walls and an upper surface forming an acute angle with a least one of the pair of side walls.

6 Claims, 1 Drawing Sheet

REFINING ELEMENT

FIELD OF THE INVENTION

The present invention relates to refining elements for use in refiners for working lignocellulosic fibrous material, in which the refining members which rotate relative to each other are provided with refining elements, which between themselves form a refining gap. The refining elements are provided with bars and intermediate grooves for working the material. The refining means can be angular in relation to the radial plane, so that a conical refining gap is formed between opposed refining elements, or can be formed with a radial portion located nearest to the rotation axis and a subsequent conical portion. The refining means with the conical surface located inside is rotary, while the refining means with the conical surface located outside is stationary.

BACKGROUND OF THE INVENTION

A specific field of application for the present invention is refiners for the manufacture of fiber—or papermaking pulp from wood chips or similar cellulosic material. Refiners of the disc-type are formed with a refining gap between the refining elements of the refining members extending in the radial direction, which gap proceeds from a central feed zone for the raw material where the centrifugal force is relatively low. The centrifugal force acting on the refining material then increases very strongly with increasing radius. In order to prolong the stay-time in the outer portion of the refining gap, the refining gap in the outer portion can be conical, with an extension at an angle in relation to the radial direction, so that only part of the centrifugal force is able to act on the refining material in the flow direction of flow within the gap. The refining gap thus consists of an inner radial zone and an outer conical zone.

The above discussion implies that the refining material in the conical zone is thrown outwardly to the refining elements located outwardly by the effect of the centrifugal force and the bars on the refining elements located inwardly. The refining material substantially contains fibrous material, but impurities in the form of sand and other abrasive materials can in certain cases follow along with the fibrous material. The aforesaid flow conditions can thus create increased wear of the bars on the refining element located outwardly. It has been found that wear primarily manifests itself on the edges of the bars on these refining elements being worn at least twice as fast as corresponding bar edges on the inwardly located refining elements. As the wear of the bars on the refining elements causes a deterioration of the quality of the worked material, the refining elements must be exchanged before their quality has become unacceptable. Furthermore, the energy consumption in the refiner increases. Every exchange of refining elements is not only expensive, but it also means that the refiner must be taken out of operation, which means loss of production.

One object of the present invention is to reduce the above problems, in that the refining elements intended for the outwardly located refining means in the conical zone has a configuration which to the greatest possible extent counteracts the wear thereof.

SUMMARY OF THE INVENTION

This and other objects have now been achieved by the discovery of a refining element for use in a refining apparatus for the refining of lignocellulosic fibrous material between a pair of refining members including a first refining member comprising an inner rotary refining member including an outwardly facing conical surface and a second refining member comprising an outer stationary refining member including an inwardly facing conical surface mounted in juxtaposition with the first refining member whereby the conical surfaces face either other and define a refining gap therebetween for refining the lignocellulosic fibrous material, the refining element adapted for mounting on the inwardly facing conical surface and including a plurality of bars and intermediate grooves, the plurality of bars extending along the refining gap including a pair of side walls and an upper surface, the upper surface forming an acute angle with at least one of the pair of side surfaces. Preferably, the acute angle is between about 50° and 90°, more preferably between about 60° and 90°, and most preferably between about 70° and 80°.

In accordance with one embodiment of the refining element of the present invention, the at least one of the pair of side surfaces includes at least about one-third of the total height of the plurality of the bars. In accordance with another embodiment of the refining element of the present invention, the upper surface forms the acute angle with both of the side surfaces.

In accordance with the present invention, the above objects are thus achieved by the bars of the refining elements hereof being formed with an acute angle as described herein.

In accordance with the present invention, the bars of the refining elements can be in parallel with the generatrix of the conical surface or be angled in relation to it. The bars are defined by a front side and a rear side surface, as seen in the intended direction of the material flow over the bars, and an upper side surface, which forms a portion of the conical surface. Thus, in accordance herewith, at least the upper portion of the front side surface of the bars is inclined inwardly, so that an acute edge angle is formed between the side surface of the bars and the upper surface. This angle should be between 50° and 90°, suitably between about 60° and 90° and preferably between about 70° and 80°, and the angled portion of the side surface should be at least one third of the height of the bars.

By forming the bars in this manner, it has now been found possible to reduce the wear of the front edge of the bars. Due to the acute angle the fibrous material is more easily guided away from the front edge, whereby the wear is reduced without deterioration in the working of the fibrous material. This results in a longer service life for the refining element and reduced energy consumption at the same pulp quality.

BRIEF DESCRIPTION OF THE DRAWINGS

The present invention is described in greater detail with reference to the following detailed description which, in turn, refers to the accompanying Figures illustrating an embodiment of the invention, in which.

DETAILED DESCRIPTION

Figure 1:
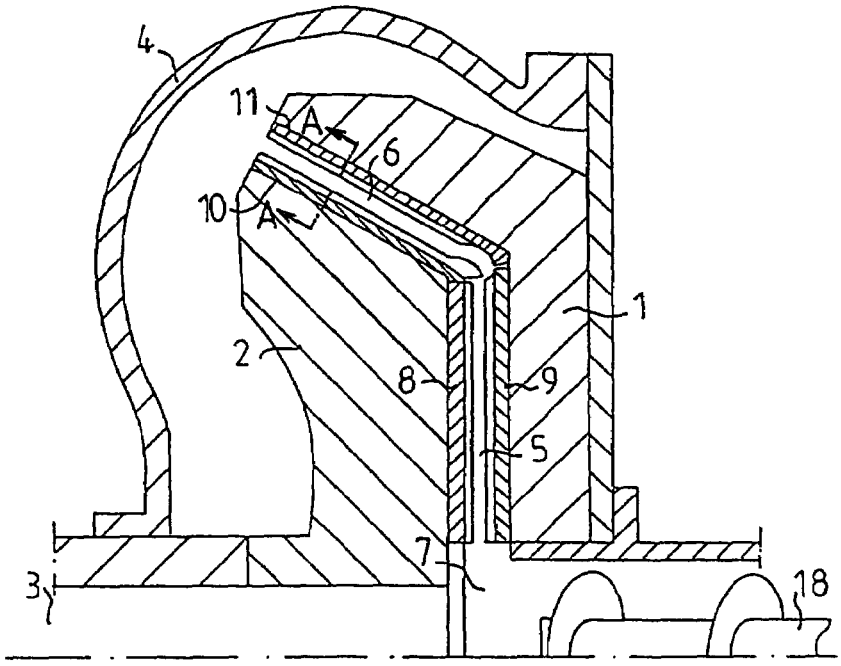
FIG. 1 is a side, elevational, sectional, schematic representation of a refiner with an inner radial and an outer angled refining gap portion.

The refiner shown in FIG. 1 is formed with a stationary refining member 1 and a rotary refining member 2 mounted on a rotary shaft 3. The refining gap can be adjusted by axial movement of the shaft 3. The refining members are enclosed in an impervious refining housing 4. Between the refining members a refining gap is formed, which consists of an inner radial portion 5 and an outer angled portion 6. The inclination angle to the rotary axis should be less than about 45°, suitably between about 10° and 30°. The stationary refining member 1 is formed with a central opening 7, through which the refining material is supplied.

Each refining member is provided with wear portions in the form of refining elements, 8-11, both in the inner radial portion of the refining gap 5 and in the outer angled portion 6. The refining elements are provided with bars 12 and intermediate grooves 13 for working and refining the refining material. The bars are defined by an upper surface 14 and two side surfaces, 15 and 16.

In the outer angled portion 6 of the refining gap the stationary refining member 1 is located outside the rotary refining member 2. The refining elements, 10 and 11, on these refining members, 1 and 2, thus, are placed outside and inside the outer angled portion 6 of the refining gap, respectively.

Figure 2:
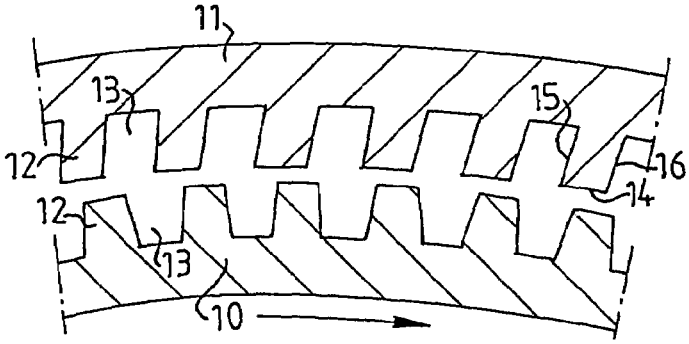
FIG. 2 is a side, elevational, partial, enlarged view of one configuration of the face of the refining elements of the present invention, taken along line A-A of FIG. 1.

According to FIG. 2 the outside located refining element 11 is provided with bars 12, where the front side surface 15, as seen in the intended flow direction of the material to be refined, forms an acute angle $\alpha$ with the upper surface 14 of the bars. The bars on the inside located refining element 10 are formed conventionally.

Figure 3:
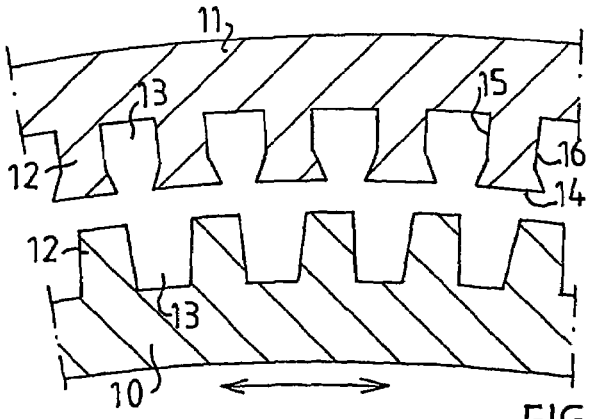
FIG. 3 is a side, elevational, partial, enlarged view of another configuration of the face of the refining elements of the present invention, taken along line A-A of FIG. 1.

According to FIG. 3 the outside located refining element 11 is provided with bars 12, where both side surfaces, 15 and 16, form an acute angle $\alpha$ with the upper surface 14. In this case the rotational direction of the inner refining element 10 can be changed and, thus, the flow direction of the material to be refined in relation to the outer refining element 11, while at the same time maintaining the effect according to the present invention. Also, with this design the bars on the inside located refining element 10 are formed conventionally.

During working of the fibrous material in the refining gap the material to be refined is supplied to the central feed zone between the refining means through the opening 7 in the stationary refining means 1 by means of a conveying screw 18, which is mounted co-axially with the shaft 3. In this manner, the material to be refined is caused to move outwardly through the inner radial portion 5 of the refining gap and worked simultaneously by the radial refining elements, 8 and 9. Thereafter the material to be refined is moved into the outer angled portion 6 of the refining gap to be worked further by the angled refining elements, 10 and 11. Due to its design and the rotation of the refining member 2, the bars on the inside located refining element 10 will throw the material to be refined outwardly to the outside located refining element 11. Due to the acute angle $\alpha$ of the bar edges the fibrous material is easier guided away from the front edge, which reduces the wear without deteriorating the working of the fibrous material. This implies a longer service life for the refining element and decreased energy consumption at maintained pulp quality.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A refining element for use in a refining apparatus for the refining of lignocellulosic fibrous material between a pair of refining members including a first refining member comprising an inner rotary refining member including an inner radial surface and an outwardly facing conical surface angularly disposed with respect to said inner radial surface and a second refining member comprising an outer stationary refining member including an inner radial surface and an inwardly facing conical surface angularly disposed with respect to said inner radial surface mounted in juxtaposition with said first refining member whereby said conical surfaces face either other and define a refining gap therebetween for refining said lignocellulosic fibrous material, said refining element adapted for mounting on said inwardly facing conical surface and including a plurality of bars and intermediate grooves, said plurality of bars extending along said refining gap including a pair of side surfaces and an upper surface, said upper surface forming an acute angle with at least one of said pair of side surfaces.

2. The refining element of claim 1 wherein said acute angle is between about 50° and 90°.

3. The refining element of claim 2 wherein said acute angle is between about 60° and 90°.

4. The refining element of claim 3 wherein said acute angle is between about 70° and 80°.

5. The refining element of claim 1 wherein said at least one of said pair of side surfaces includes at least about one-third portion of the total height of said plurality of said bars.

6. The refining element of claim 1 wherein said upper surface forms said acute angle with both of said pair of side surfaces.

* * * * *

UNITED STATES PATENT AND TRADEMARK OFFICE

CERTIFICATE OF CORRECTION

PATENT NO. : 7,451,946 B2 
APPLICATION NO. : 10/541478
DATED : November 18, 2008
INVENTOR(S) : Nils Virving It is certified that error appears in the above-identified patent and that said Letters Patent is hereby corrected as shown below:

Title Page;
On the face of the patent (57) ABSTRACT, line 8, delete “a” and insert therefor --at--.
Column 1, line 59, delete “has” and insert therefor --have--.
Column 2, line 7, delete “either” and insert therefor --each--.
Column 4, line 29, delete “either” and insert therefor --each--.

Signed and Sealed this

Third Day of February, 2009

John Doll

JOHN DOLL
*Acting Director of the United States Patent and Trademark Office*